US007800004B2

(12) United States Patent
Kerr

(10) Patent No.: US 7,800,004 B2
(45) Date of Patent: Sep. 21, 2010

(54) SAFETY SWITCH

(75) Inventor: David Howard Kerr, Burscough (GB)

(73) Assignee: Rockwell Automation Limited, Milton Keynes (GB)

( * ) Notice: Subject to any disclaimer, the term of this patent is extended or adjusted under 35 U.S.C. 154(b) by 610 days.

(21) Appl. No.: 11/759,296

(22) Filed: Jun. 7, 2007

(65) Prior Publication Data

US 2008/0023307 A1 Jan. 31, 2008

(30) Foreign Application Priority Data

Jul. 28, 2006 (GB) ..... 0614994.2

(51) Int. Cl.
*H01H 1/20* (2006.01)

(52) U.S. Cl. ..... 200/243

(58) Field of Classification Search ..... 200/243, 200/245, 239–241
See application file for complete search history.

(56) References Cited

U.S. PATENT DOCUMENTS

| | | | | |
|---|---|---|---|---|
| 6,483,049 | B1 * | 11/2002 | Mohtasham | 200/243 |
| 6,720,508 | B2 * | 4/2004 | Moriyama et al. | 200/200 |
| 2006/0000700 | A1 * | 1/2006 | Kerr | 200/400 |

* cited by examiner

*Primary Examiner*—Felix O Figueroa
(74) *Attorney, Agent, or Firm*—Boyle Fredrickson LLP; William R. Walbrun; John M. Miller

(57) ABSTRACT

A safety switch plunger includes a moveable conductor which extends transversely through the plunger and protrudes from opposite sides of the plunger. The plunger is provided with a structure that is positionally fixed on the plunger. The structure is positioned such that it is arranged to come into physical contact with and affect the movement of the moveable conductor when the moveable conductor and plunger are moved relative to one another thereby providing a fail-to-safe safety switch.

20 Claims, 7 Drawing Sheets

SAFETY SWITCH

CROSS-REFERENCE TO RELATED APPLICATION

This application claims priority under 35 U.S.C. §119 to United Kingdom Patent Application No. 0614994.2, filed on Jul. 28, 2006, the entirety of which is incorporated by reference herein.

BACKGROUND OF THE INVENTION

The present invention relates to a safety switch plunger and a safety switch.

Safety switches are well known, and are typically used to prevent access to for example electromechanical machinery when that machinery is in operation. In a conventional arrangement the safety switch is mounted on a doorpost of a machinery guard, and an actuator for the safety switch is mounted on a corresponding door. When the door is closed the actuator engages with the safety switch, which in turn closes a set of electrical contacts which allow power to be supplied to the machinery. This arrangement ensures that power can only be supplied to the machinery when the guard door is shut. When the guard door is opened, the actuator disengages from the safety switch, thereby opening the electrical contacts and cutting off the supply of power to the machinery.

A typical safety switch comprises a housing, in which is provided a set of contacts fixed in position relative to the housing. An axially slideable plunger is mounted inside the housing, and is moveable relative to the housing. The plunger is provided with another set of contacts. The plunger is biased towards a cam arrangement by a spring. The actuator mentioned above is arranged to engage with the cam arrangement.

In many safety switches, if the actuator is not engaged with the cam arrangement (i.e. if the actuator is not engaged with the safety switch), the cam arrangement is arranged to prevent the contacts on the plunger coming into contact with the contacts of the housing by preventing movement of the plunger (i.e. the plunger is kept in a first plunger position). By preventing the contacts from contacting one another, the switch cannot conduct electricity while the actuator is engaged with the cam arrangement.

Bringing the actuator into engagement with the cam arrangement causes the cam arrangement to rotate, which in turn causes the plunger (which is biased toward the cam arrangement) to move into a notch provided in the cam arrangement. The plunger is then in a second plunger position. When the plunger moves into the notch, the contacts on the plunger are brought into contact with the contacts of the housing, allowing electricity to flow through the safety switch.

Should the cam arrangement fail (e.g. become worn, cracked, or be displaced etc) the spring may cause the plunger to move further than intended (i.e. to a third plunger position). In the above example, if the cam arrangement is removed (for example due to an impact on the switch) the spring will still bias the plunger toward where the cam arrangement would have been. Thus, even when the cam arrangement is not present, the contacts of the housing may be brought into contact with the contacts of the plunger, allowing electricity to flow through the switch. In summary, if the cam fails, the switch defaults to the situation where it supplies electricity. This is known in the industry as a 'fail to danger'.

If the cam arrangement fails when the door to the machinery guard is open, the switch will conduct electricity, and machinery within the guard will be either powered, or powered and operating. This is undesirable, since the purpose of the safety switch is to only allow electricity to be supplied to the machinery when the door to the machinery guard is closed.

If the cam arrangement fails when the door to the machinery guard is closed and the machinery is in operation, it may not be possible to identify the failure until the door has been opened. When the door has been opened, the machinery will continue to operate, highlighting a failure with the safety switch.

It is desired to overcome or substantially mitigate the above-mentioned disadvantages.

BRIEF SUMMARY OF THE INVENTION

According to a first aspect of the present invention there is provided a safety switch plunger having a moveable conductor which extends transversely through the plunger and protrudes from opposite sides of the plunger. The plunger is also provided with a structure that is fixed in position on the plunger, the structure being positioned such that it is arranged to come into physical contact with and affect the movement of the moveable conductor when the moveable conductor and plunger are moved relative to one another by a predetermined amount.

Preferably, the structure is arranged to cause the moveable conductor to rotate or pivot when the moveable conductor and plunger are moved relative to one another by the predetermined amount.

Preferably, the structure is a frame which extends away from the plunger. Preferably, the frame extends perpendicularly away from the plunger. Preferably, the frame defines three sides of a rectangle. Alternatively, the structure may comprise an arm which extends away from the plunger, the arm being provided with a hook at an end of the arm remote from the plunger.

Preferably, the moveable conductor is provided with a lip arranged to come into physical contact with the structure when the moveable conductor and plunger are moved relative to one another by the predetermined amount. Alternatively, the moveable conductor may be provided with an insulating barrier, the insulating barrier being provided with a lip arranged to come into physical contact with the structure when the moveable conductor and plunger are moved relative to one another by the predetermined amount. Preferably, the lip extends away from the plunger. Preferably, the lip extends perpendicularly away from the plunger.

According to a second aspect of the present invention there is provided a safety switch comprising: a housing; a fixed conductor located within the housing and fixed in position relative to the housing; a plunger, axially moveable within the housing and provided with a moveable conductor which extends transversely through the plunger and protrudes from opposite sides of the plunger; a biasing element, arranged to bias the plunger into contact with a cam arrangement and arranged to bias the plunger such that the moveable conductor of the plunger is biased toward and into electrical connection with the fixed conductor, the cam arrangement being configured such that rotation of the cam arrangement will allow the plunger to move and to bring the moveable conductor of the plunger into electrical connection with the fixed conductor of the housing. The plunger is provided with a structure that is fixed in position on the plunger and is being positioned such that it is arranged to come into physical contact with and affect the movement of the moveable conductor when the moveable conductor and plunger are moved relative to one another by a predetermined amount, such that at least a part of the moveable conductor is moved out of electrical connection with the fixed conductor, so that the safety switch is incapable of conducting electricity.

Preferably, the predetermined amount of relative movement corresponds to an increased movement of the plunger due to a failure of the cam arrangement.

Preferably, the structure is arranged to cause the moveable conductor to rotate or pivot when the moveable conductor and plunger are moved relative to one another by the predetermined amount. Preferably, the structure is arranged to cause the moveable conductor to rotate or pivot about the fixed conductor.

Preferably, the structure is a frame which extends away from the plunger. Preferably, the frame extends perpendicularly away from the plunger. Preferably, the frame defines three sides of a rectangle. Alternatively, the structure may comprise an arm which extends away from the plunger, the arm being provided with a hook at an end of the arm remote from the plunger.

Preferably, the moveable conductor is provided with a lip arranged to come into physical contact with the structure when the moveable conductor and plunger are moved relative to one another by the predetermined amount. Alternatively, the moveable conductor may be provided with an insulating barrier, the insulating barrier being provided with a lip arranged to come into physical contact with the structure when the moveable conductor and plunger are moved relative to one another by the predetermined amount. Preferably, the lip extends away from the plunger. Preferably, the lip extends perpendicularly away from the plunger.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
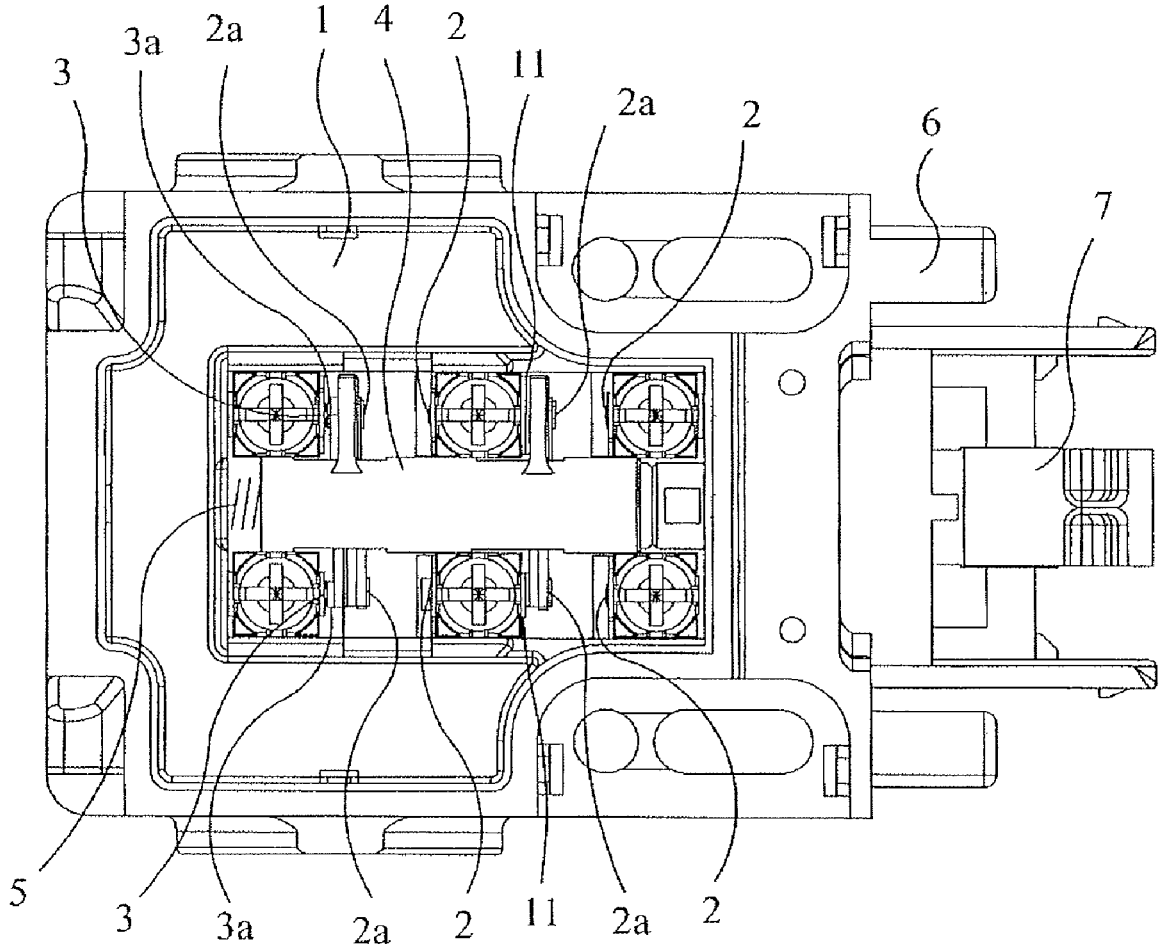
FIG. 1 depicts a safety switch according to an embodiment of the present invention.

FIG. 1 depicts a plan view of a safety switch according to an embodiment of the present invention. The safety switch comprises a two-part housing. One part of the housing defines a main body 1 of the safety switch. Mounted within the body 1 are electrical contacts which are fixed in position relative to the body 1. The contacts consist of two fixed safety contacts 2 and a fixed auxiliary contact 3. Also mounted within the body 1 is a plunger 4 which is slideable relative to the body 1 in an axial direction. The plunger 4 is provided with a plurality of contacts which are moveable relative to the plunger 4. The moveable contacts comprise two moveable safety contacts 2*a* and a moveable auxiliary contact 3*a*. By moving the plunger 4, the moveable contacts 3*a*, 4*a* can be brought into contact (and thus electrical connection) with the fixed contacts 3, 4 of the safety switch. The plunger 4 is also provided with a moveable insulating barrier 11 which serves to provide additional electrical insulation for some of the moveable safety contacts 2*a*.

The plunger 4 is biased by a spring 5 towards a second part of the housing, which forms a head 6 of the safety switch. The head 6 of the safety switch is provided with a rotatable cam arrangement 7. The cam arrangement 7 is arranged to receive and engage with an actuator (not shown in FIG. 1). Engagement or disengagement of the actuator with the cam arrangement 7 causes the cam arrangement 7 to rotate, which in turn causes axial movement of the plunger 4 within the body 1 of the safety switch.

Figure 2A:
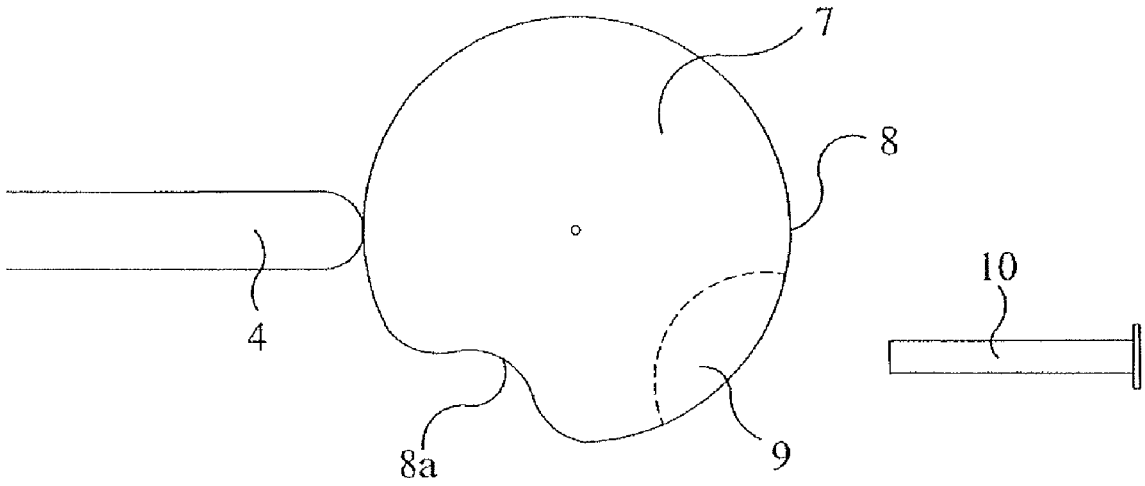
FIGS. 2*a* and 2*b* depict a cam arrangement of the safety switch of FIG. 1.
Figure 2B:
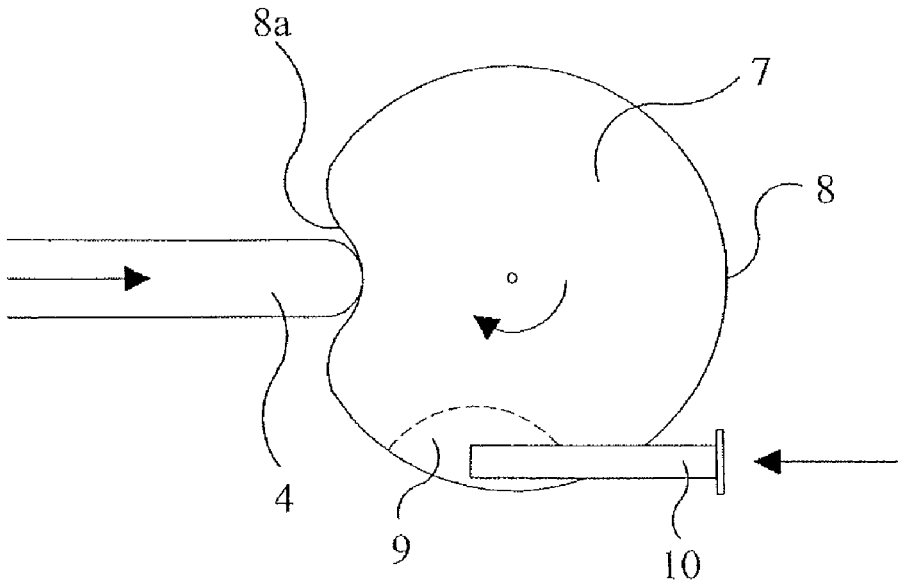

FIGS. 2*a* and 2*b* illustrate the interaction between the cam arrangement 7 and the plunger 4 in more detail. FIG. 2*a* shows that the cam arrangement 7 defines a cam surface 8. The cam surface 8 is provided with an indentation 8*a* which is (upon rotation of the cam arrangement 7) arranged to receive the plunger 4. The cam arrangement 7 is also provided with a notch 9 for receiving and engaging with an actuator. It can be seen from FIG. 2*a* that when no actuator is brought into engagement with the cam arrangement 7, the cam arrangement pushes back against the plunger 4 (which is biased toward the cam arrangement 7 by the spring 5) and prevents the plunger 4 from moving towards the cam arrangement 7. The plunger 4 is said to be in a first plunger position.

It can be seen from FIG. 1 (in combination with FIG. 2*a*) that when no actuator is brought into engagement with the cam arrangement 7 all of the fixed safety contacts 2 of the body 1 of the safety switch are kept apart from all of the moveable safety contacts 2*a* of the plunger 4. Thus, when no actuator is engaged with the cam arrangement 7, the safety contacts 2, 2*a* are not in electrical connection with each other, which prevents the safety switch from conducting electricity (to, for example, electrically powered machinery with a machine guard). When no actuator is engaged, the auxiliary contacts 3, 3*a* are in contact with each other, which may allow an auxiliary power supply to be supplied to the switch (for example, to power a light which indicates that no actuator has been engaged with the switch).

FIG. 2*b* depicts an actuator 10 that has been brought into engagement with the cam arrangement 7. It can be seen from FIG. 2*b* that when the actuator 10 has been brought into engagement with the cam arrangement 7, the cam arrangement 7 and therefore cam surface 8 is arranged to rotate in a clockwise direction. Rotation of the cam arrangement 7 causes the indentation 8*a* in the cam surface 8 to be brought into alignment with the plunger 4. As the indentation 8*a* moves into alignment with the plunger 4, which is biased by the spring 5, the plunger 4 moves towards the right of FIG. 2*b*. The plunger 4 is said to be in a second plunger position.

Figure 3:
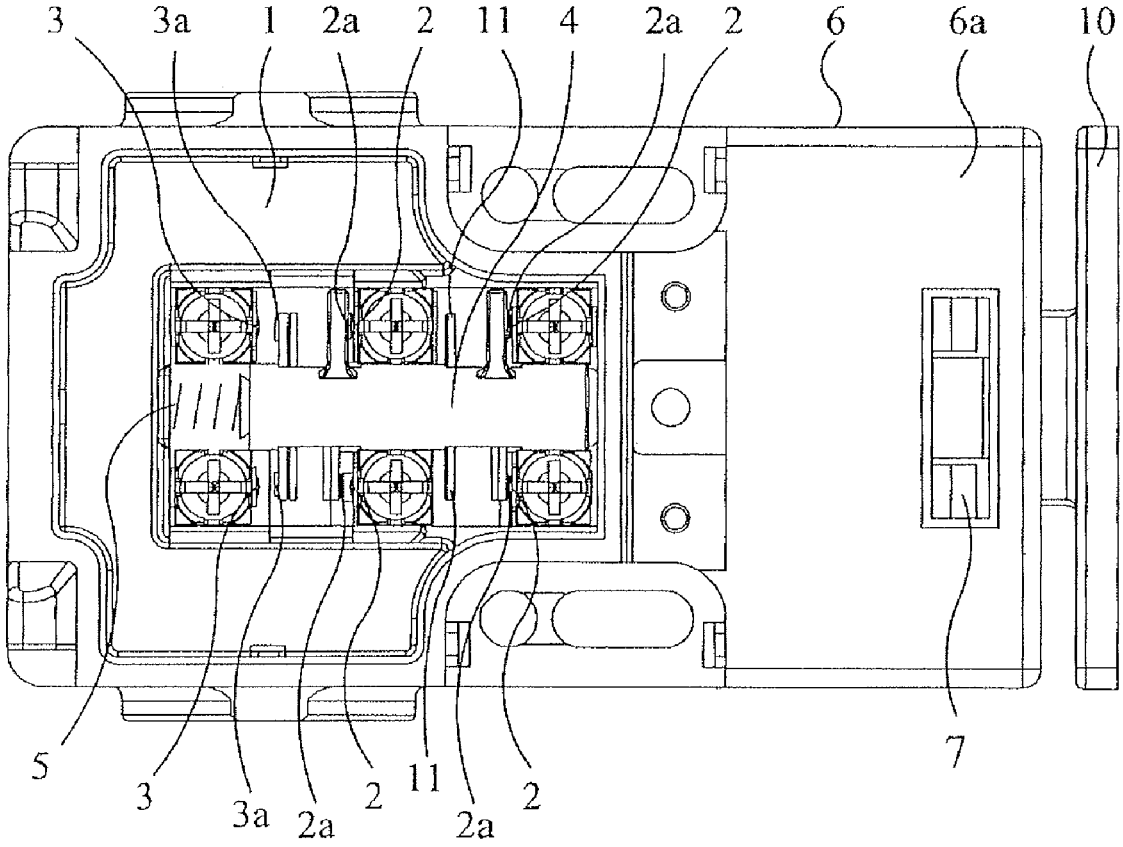
FIG. 3 depicts operating principles of the safety switch of FIG. 1.

FIG. 3 shows the safety switch with an end cap 6*a* enclosing the head 6 of the safety switch. The end cap 6*a* protects the cam arrangement 7 from damage, dust etc, and makes the safety switch appear more aesthetically pleasing. It can be seen from FIG. 3 that when the actuator 10 is brought into engagement with the cam arrangement 7, the plunger 4 moves towards the right of FIG. 3. When the plunger 4 moves to the right, all of the moveable safety contacts 2*a* are brought into electrical connection with the fixed safety contacts 2 of the body 1 of the safety switch. When all of the safety contacts 2, 2*a* are brought into electrical connection with each other, the switch is capable of conducting electricity (to, for example, electrically powered machinery with a machine guard). The safety switch is configured such that if one or more of the safety contacts 2, 2*a* are not in electrical connection with each other, the switch is incapable of conducting electricity. The significance of this configuration will be described further below.

It can be seen from FIGS. 1, 2 and 3 that movement of the plunger 4 towards the right of the Figures allows the safety switch to conduct electricity, since the safety contacts 2, 2*a* are brought into electrical connection with each other. In the prior art safety switches, if the cam arrangement were to fail (e.g. become worn, cracked, displaced, removed etc.) then the plunger, which is biased by the spring, will continue to be biased towards the right of the Figures. Thus, in prior art safety switches, if the cam arrangement fails, the safety contacts will be brought into connection with one another, and maintained in that position. Specifically, if the cam arrangement fails, the prior art safety switch will fail to danger, in that the failure of the cam arrangement will leave the switch in a configuration in which it is still capable of conducting electricity. This problem is overcome by the present invention due to the design of the plunger 4, as shown in more detail in FIG. 4.

Figure 4:
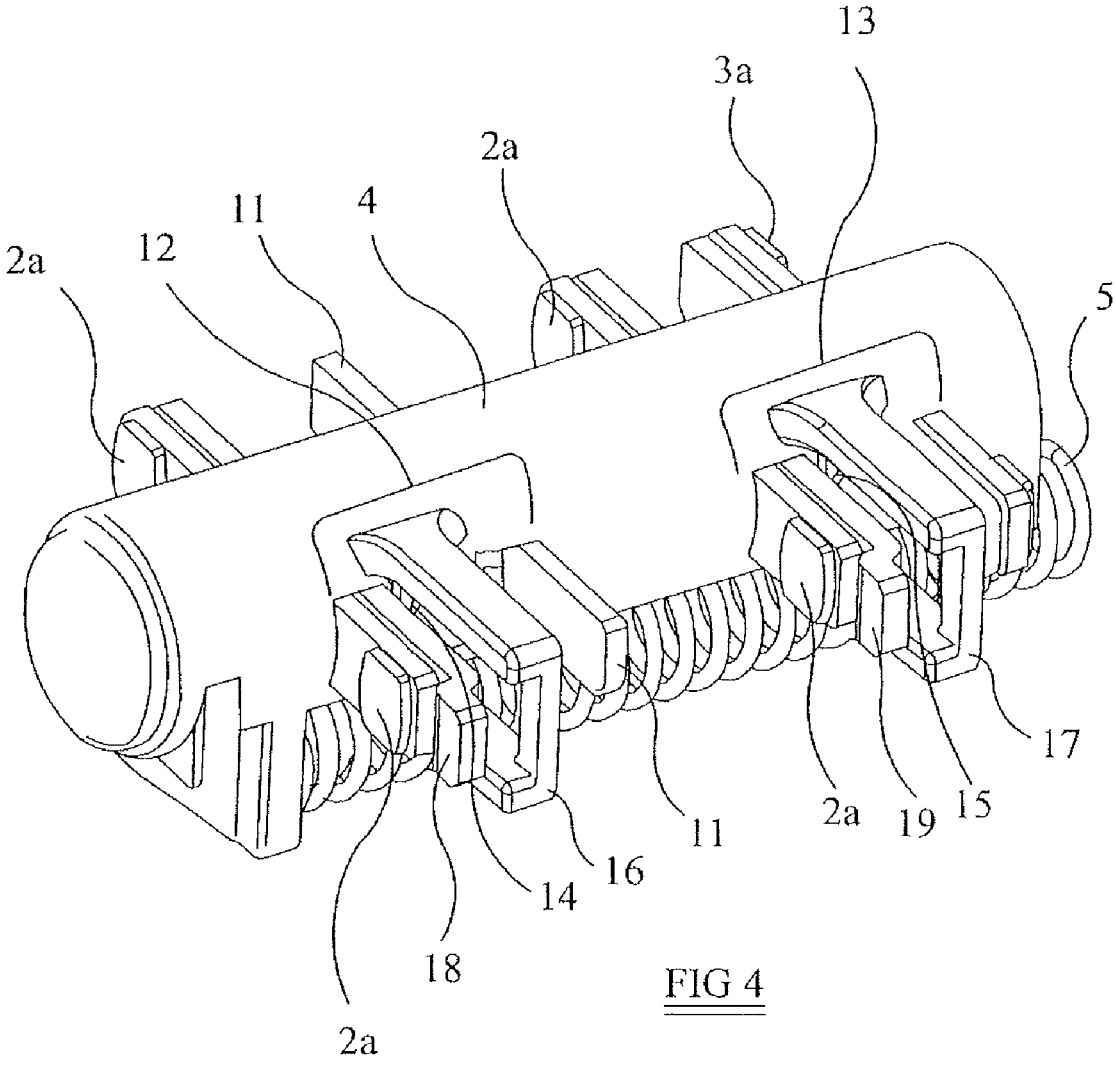
FIG. 4 depicts a plunger according to an embodiment of the present invention.

FIG. 4 illustrates a plunger 4 according to an embodiment of the present invention. As already described above, the plunger 4 is provided with moveable safety contacts 2*a*, and a moveable auxiliary contact 3*a*. The plunger is also provided with a moveable insulating barrier 11 which serves to provide additional electrical insulation for some of the moveable safety contacts 2*a*.

The moveable contacts 2*a*, 3*a* and insulating layer 11 extend through the plunger 4 in a direction perpendicular to the length of the plunger 4. The moveable contacts 2*a*, 3*a* and insulating barrier 11 are moveable along parts of the length of the plunger 4. Movement of the moveable contacts 2*a*, 3*a* and insulation barrier 11 is restricted by windows 12, 13 provided in the plunger 4 (more clearly visible in FIGS. 5 and 6), and through which the moveable contacts 2*a*, 3*a* and insulation barrier 11 extend. The moveable contacts 2*a*, 3*a* and insulation barrier 11 are separated from contacting each other within each window 12, 13 by way of helical springs 14, 15 (more clearly visible in FIGS. 5 and 6). The helical springs 14, 15 ensure that one of the moveable safety contacts 2*a* and insulation barrier 11 of one window 12 are biased apart from each other, and that one of the moveable safety contacts 2*a* and moveable auxiliary contacts 3*a* of the other window 13 are also biased apart from each other. The helical springs 14, 15 bias the moveable safety contacts 2*a*, auxiliary contact 3*a* and insulation barrier 11 to the ends of their respective windows 12, 13. The features of the plunger 4 described so far are well known in the art.

The plunger 4 according to an embodiment of the present invention differs from prior art plungers in that it is provided with two frames 16, 17 that extend perpendicularly away from the surface of the plunger 4, and which are fixed in position relative to the plunger 4. The frames 16, 17 may be formed integrally with the plunger 4. The frames are substantially rectangular in shape, in that they define three sides of a rectangle, the fourth and final side of the rectangle being formed by the plunger 4 itself. The moveable safety contacts 2*a* (or structures to which the moveable safety contacts 2*a* are attached, e.g. an insulating layer) are each provided with a lip 18, 19 which extends in a direction substantially perpendicularly away from the plunger 4.

The plunger 4 and its constituent parts may be formed from any suitable material. For example, the plunger 4 and its constituent parts may be formed from plastic.

When the moveable safety contacts 2*a* are moved relative to the plunger 4, they are also moved relative to the frames 16, 17 because the frames 16, 17 are fixed in position relative to the plunger 4. When the moveable safety contacts 2*a* have been moved by a predetermined amount (which is set to correspond to a failure of the cam arrangement), the lips 18, 19 of the moveable safety contacts 2*a* press against the outermost extent of the frames 16, 17. When the lips 18, 19 of the moveable safety contacts 2*a* come into contact with the frames 16, 17, the movement of the moveable safety contacts 2*a* can be affected. Specifically, movement of the moveable safety contacts 2*a* can be affected in such a way as to overcome the problems of the prior art discussed above. The function of the plunger 4 according to an embodiment of the present invention is highlighted in FIG. 5.

Figure 5:
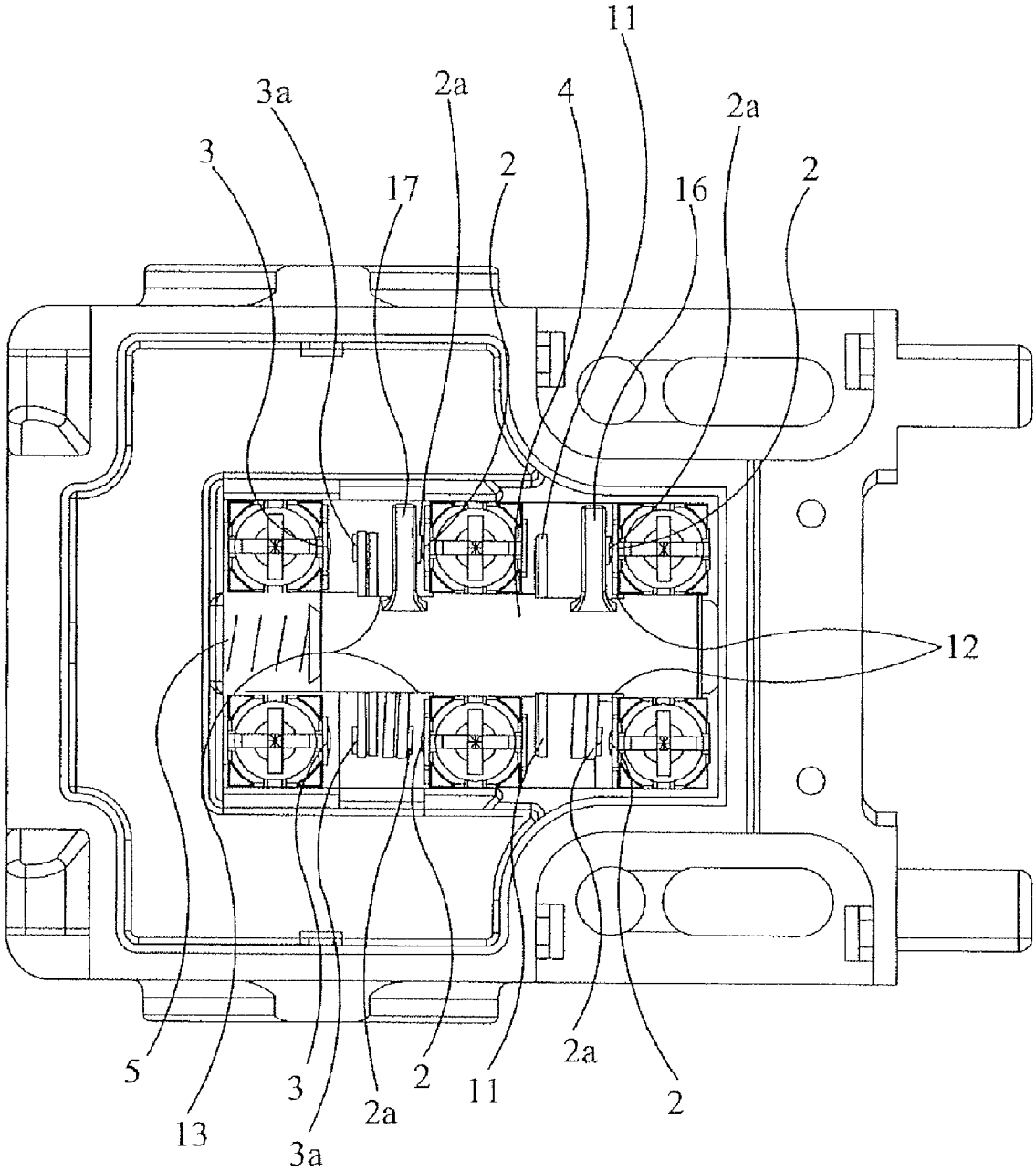
FIGS. 5, 6 and 7 depict further operating principles of embodiments of the present invention.
Figure 6:
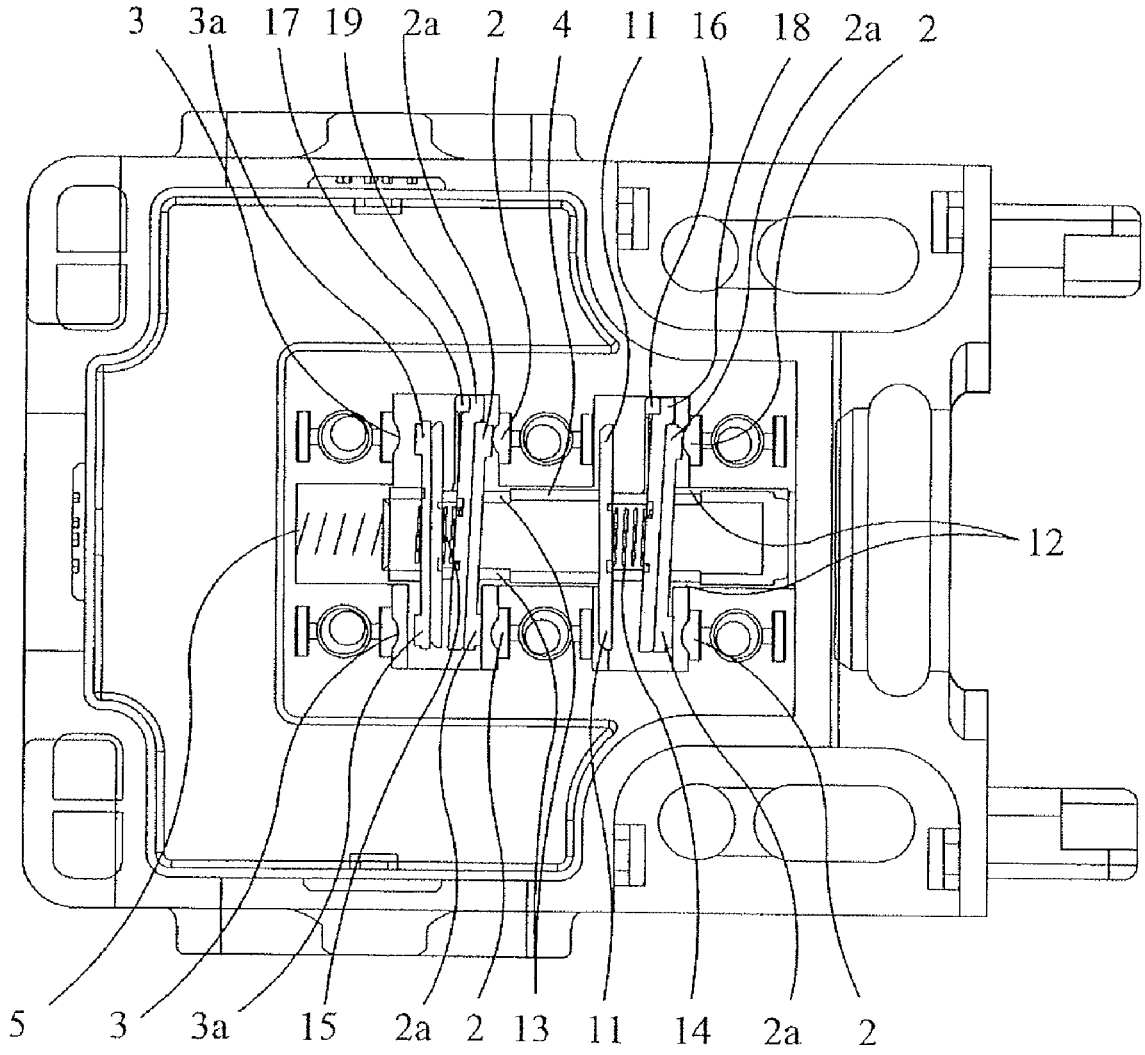

FIG. 5 illustrates the safety switch according to an embodiment of the present invention. In this particular example, the cam arrangement has failed in that the cam arrangement has been displaced due to the head 6 of the safety switch becoming detached from the body 1. FIG. 6 shows the safety switch of FIG. 5 in cross section so that the operation of the plunger 4 and the movement of the moveable safety contacts 2*a* may be more easily seen.

Referring back to FIG. 2*b*, it was described how the plunger 4 moved from a first position when no actuator 10 was engaged with the cam arrangement 7, to a second position when an actuator 10 was brought into engagement with the cam arrangement 7. When the cam arrangement 7 fails (e.g. when there is no cam arrangement at all) the plunger 4 is biased by the spring 5 into a third position which is beyond the position to which the plunger has moved in FIG. 2*b*—i.e. when the cam arrangement 7 fails the cam arrangement 7 is no longer restricting the movement of the plunger 4 away from the spring 5. In prior art safety switches, this would result in the moveable safety contacts 2*a* of the plunger 4 staying in electrical connection with the fixed safety contacts 2 of the body 1 of the safety switch. However, due to the frames 16, 17 and lips 18, 19 of the plunger of the present invention, this situation is avoided.

It can be seen from FIGS. 5 and 6 that when the cam arrangement fails, the plunger 4 extends even further towards the end of the switch where the head 6 was originally located. Such movement of the plunger 4 causes the frames 16, 17 of the plunger to be brought into physical contact with the lips 18, 19 of the moveable safety contacts 2*a*. When the frames 16, 17 of the plunger 4 are brought into contact with the lips 18, 19 of the moveable safety contacts 2*a*, the moveable safety contacts 2*a* are moved by the frames 16, 17.

Figure 7:
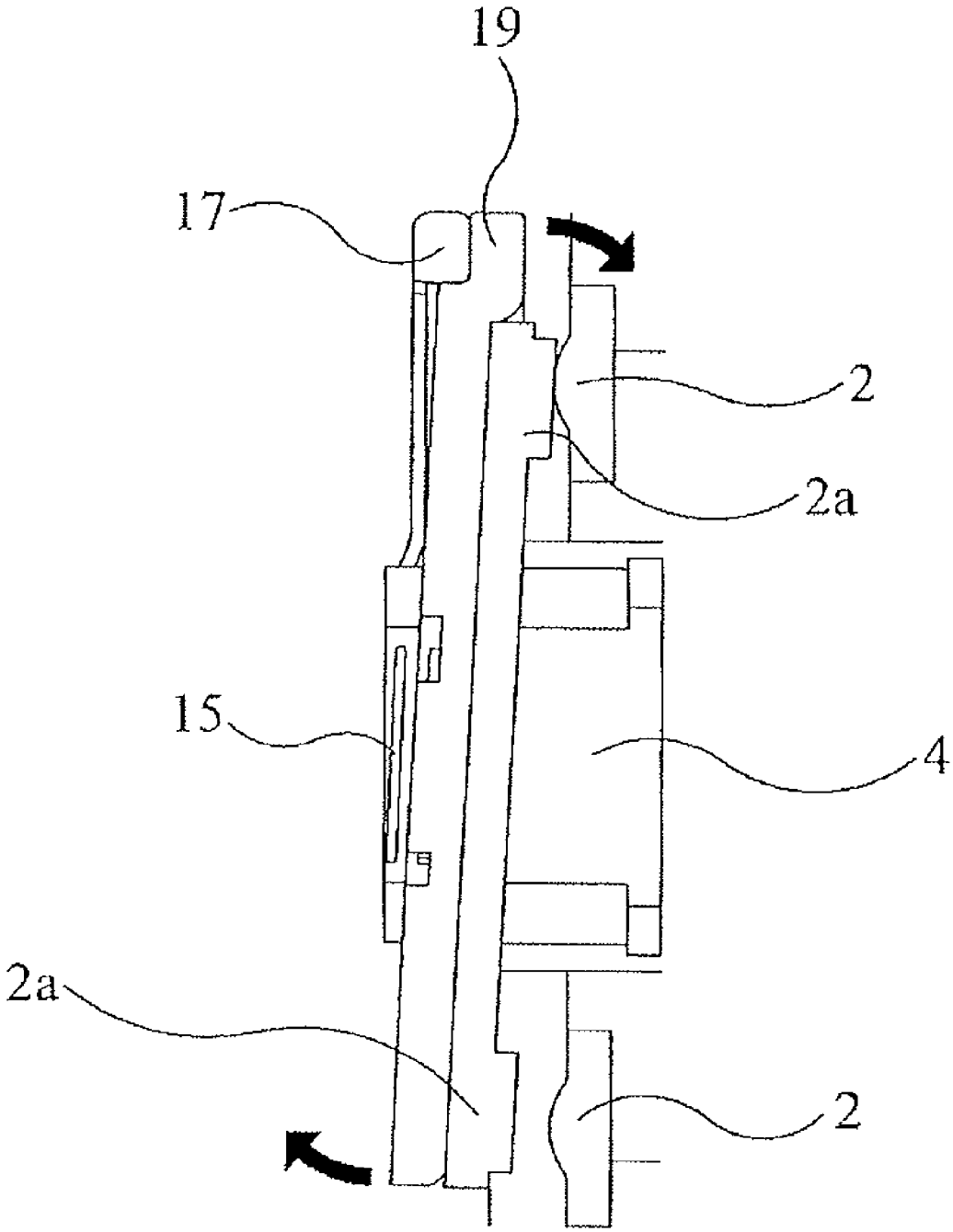

It can be seen from FIGS. 5 and 6 that the moveable safety contacts 2*a* are moved by the frames 16, 17 such that not all of the moveable safety contacts 2*a* of the plunger 4 are in contact with the fixed safety contacts 2 of the body 1 of the safety switch. Specifically, the lips 18, 19 and frames 16, 17 cause the moveable safety contacts 2*a* to be pivoted about one of the fixed contacts 2 of the body 1 of the safety switch, such that one end of the moveable safety contacts 2*a* is rotated relative to the other. This is shown more clearly in FIG. 7. Since not all of the safety contacts 2, 2*a* are in electrical connection with each other, the safety switch will not conduct electricity. Thus, by using a plunger 4 according to an embodiment of the present invention, the safety switch no longer fails to danger when the cam arrangement fails, but instead fails to a safe (i.e. non-conducting) configuration.

It will be appreciated that the plunger of the present invention may be used in existing safety switches. For example, the plunger may be retrofitted to safety switches which have already been installed, replacing a prior art plunger. A prior art safety switch can therefore be made to fail-safe by replacing the prior art plunger with the plunger of the present invention. Alternatively, a safety switch incorporating a plunger according to the present invention may be manufactured, sold etc. as a single unit.

In the embodiments described above, a plurality of safety contacts has been described. However, it will be appreciated that any suitable configuration of safety contacts (and even auxiliary contacts) may be employed. For example, a plunger may be provided with only a single safety contact, and not two as shown in the Figures.

It will be understood by the skilled person that a contact is a conductor which may be shaped at each of its ends, i.e. to define contact points. In the above-described embodiments, the moveable safety and auxiliary contacts are conductors which extend transversely through the plunger, and protrude from both sides of the plunger. The fixed contacts are conductors fixed in position relative to the housing of the safety switch.

In the above-described embodiments, a frame 16 has been described as the structure responsible for affecting the movement of the moveable safety contacts 2*a* by incorporation of a lip 18 on or adjacent to the moveable safety contacts 2*a*. However, it will be appreciated that the use of a frame fixed in position on the plunger is not necessary, nor is the use of a lip on the moveable safety contacts. Preferably, the plunger is provided with a structure that is fixed in position on the plunger and the structure is positioned such that it is arranged to come into physical contact with and effect the movement of the moveable conductor (i.e. contacts) of the plunger when there is a predetermined amount of relative movement between the plunger and the moveable conductor. The predetermined amount of movement can be selected to correspond to a failure of the cam arrangement, so that at least a part of the moveable conductor (i.e. moveable safety contact) is brought out of electrical connection with the fixed contacts of the safety switch when the cam arrangement fails. The structure can be any suitable structure, for example an arm or protrusion extending from the plunger. The moveable conductor could be provided with any suitable abutment surface or latching surface arranged to come into physical contact with the structure. For example, the moveable conductor could be provided with an arm that extends from the plunger, the arm being provided with a hook at an end of the arm remote from the plunger.

The plunger of the present invention has been described in relation to a safety switch having a fixed set of contacts located and fixed in position in the housing of the safety switch. The fixed contacts of the housing may be individually fixed or integral to the housing, or may form part of a safety switch contact block. The safety switch contact block is a structure that is provided with the fixed contacts (or conductors). The safety switch contact block is generally fixed in position into the housing. Accordingly, it is envisioned that the fixed safety contacts (conductors) may be formed integrally with the housing, individually fixed in position in the housing, or form part of a contact block which is itself fixed in position in the housing.

It will be appreciated by a person skilled in the art that the invention is not limited to the embodiments described above, and that various modifications may be made to those and other embodiments without departing from the invention, which is defined by the claims which follow.

What is claimed is:

1. A plunger of a safety switch comprising:

a moveable conductor which extends transversely through the plunger and protrudes from opposite sides of the plunger; and wherein the plunger is also provided with a structure that is fixed in position on the plunger, the structure extending in a radially outward direction from the plunger to overlap an area associated with movable conducting engagement of the moveable conductor and being positioned such that it is arranged to come into physical contact with and affect movement of the moveable conductor when the moveable conductor and plunger are moved relative to one another by a predetermined amount.

2. The safety switch plunger as claimed in claim 1, wherein the structure is arranged to cause the moveable conductor to one of rotate or pivot when the moveable conductor and plunger are moved relative to one another by the predetermined amount.

3. The safety switch plunger as claimed in claim 1, wherein the structure is a frame which extends away from the plunger to overlap one side of the moveable conductor with respect to the opposite sides of the plunger.

4. The safety switch plunger as claimed in claim 3, wherein the frame extends perpendicularly away from the plunger.

5. The safety switch plunger as claimed in claim 3, wherein the frame defines three sides of a rectangle.

6. The safety switch plunger as claimed in claim 1, wherein the structure comprises an arm which extends away from the plunger, the arm being provided with a hook at an end of the arm remote from the plunger.

7. The safety switch plunger as claimed in claim 1, further comprising a lip extending from one of the moveable conductor and an insulating barrier of the moveable conductor, the lip being arranged to come into physical contact with the structure when the moveable conductor and the plunger are moved relative to one another by the predetermined amount.

8. The safety switch plunger as claimed in claim 7, wherein the lip one of extends away from the plunger and extends generally perpendicularly away from the plunger.

9. A safety switch comprising:

a housing;

a fixed conductor located within the housing and fixed in position relative to the housing;

a plunger, axially moveable within the housing and provided with a moveable conductor which extends transversely through the plunger and protrudes from opposite sides of the plunger;

a biasing element, arranged to bias the plunger into contact with a cam arrangement and arranged to bias the plunger such that the moveable conductor of the plunger is biased toward and into electrical connection with the fixed conductor, the cam arrangement being configured such that rotation of the cam arrangement will allow the plunger to move and to bring the moveable conductor of the plunger into electrical connection with the fixed conductor of the housing; and wherein the plunger is provided with a structure that is fixed in position on the plunger, the structure being positioned such that it is arranged to extend in a radially outward direction from an elongated body of the plunger and generally along a backside of the moveably conductor and come into physical contact with and affect movement of the moveable conductor when the moveable conductor and plunger are moved relative to one another by a predetermined amount, such that at least a part of the moveable conductor is moved out of electrical connection with the fixed conductor, so that the safety switch is incapable of conducting electricity.

10. The safety switch as claimed in claim 9, wherein the predetermined amount of relative movement corresponds to a movement of the plunger due to a failure of the cam arrangement.

11. The safety switch as claimed in claim 9, wherein the structure is arranged to cause the moveable conductor to one of rotate or pivot when the moveable conductor and plunger are moved relative to one another by the predetermined amount.

12. The safety switch as claimed in claim 9, wherein the structure is arranged to cause the moveable conductor to one of rotate or pivot about the fixed conductor.

13. The safety switch as claimed in claim 9, wherein the structure is a frame which extends away from the plunger in a direction of one of the opposite sides of the plunger.

14. The safety switch as claimed in claim 13, wherein the frame extends perpendicularly away from the plunger.

15. The safety switch as claimed in claim 13, wherein the frame defines three sides of a rectangle.

16. The safety switch as claimed in claim 9, wherein the structure comprises an arm which extends away from the plunger, the arm being provided with a hook at an end of the arm remote from the plunger.

17. The safety switch as claimed in any of claim 10, further comprising a lip extending from one of the moveable conductor and an insulating barrier of the moveable conductor, the lip being arranged to come into physical contact with the structure when the moveable conductor and plunger are moved relative to one another by the predetermined amount.

18. The safety switch as claimed in claim 17, wherein the lip extends one of away from the plunger or generally perpendicularly away from the plunger.

19. A safety switch assembly comprising:

a set of fixed contacts;

a set of moveable contacts;

a plunger constructed to move the moveable contacts relative to the fixed contacts such that the fixed contacts and moveable contacts can be separated;

a structure extending from the plunger and constructed to engage the contacts such that a first group of contacts including a fixed contact and a moveable contact are biased together and a second group of contacts including another fixed contact and another moveable contact are biased apart thereby severing electrical connectivity between the set of fixed contacts and the set of moveable contacts; and wherein the structure extends in a radially outward direction from the plunger so as to extend into an area that overlies a contact area of the set of fixed contacts and the set of movable contacts along a side of the moveable contact that does not face the fixed contact.

20. The safety switch assembly of claim 19 wherein the moveable contact of the second group of contacts is rotatable about the first group of contacts such that the second group of contacts maintains an open electrical condition when the structure engages the contacts.

* * * * *